US005632451A

United States Patent [19]

Pasini

[11] Patent Number: 5,632,451

[45] Date of Patent: May 27, 1997

[54] RADIALLY COMPRESSIBLE COP FOR THE WINDING OF YARN

[75] Inventor: Roberto Pasini, Assago, Italy

[73] Assignee: Mariplast Europa S.r.l., Prato, Italy

[21] Appl. No.: 377,252

[22] Filed: Jan. 24, 1995

[30] Foreign Application Priority Data

Jan. 28, 1994 [IT] Italy ..... MI94A0145

[51] Int. Cl.[6] ..... B65H 75/20; D06F 17/00

[52] U.S. Cl. ..... 242/118.11; 68/198

[58] Field of Search ..... 242/118.11, 118.1, 242/118.31, 118.2; 68/198

[56] References Cited

U.S. PATENT DOCUMENTS

| | | | |
|---|---|---|---|
| 3,563,491 | 2/1971 | Hahm et al. | 242/118.11 |
| 3,718,287 | 2/1973 | Sottosanti | 242/118.11 |
| 3,756,532 | 9/1973 | Draper | 242/118.11 |
| 3,777,515 | 12/1973 | Hattori | 242/118.11 X |
| 4,349,165 | 9/1982 | Henning et al. | 242/118.11 |
| 5,435,497 | 7/1995 | Romagnoli | 242/118.11 |

FOREIGN PATENT DOCUMENTS

| | | | |
|---|---|---|---|
| 471353 | 2/1992 | European Pat. Off. | 242/118.11 |
| 2224699 | 10/1974 | France . | |
| 2225562 | 8/1973 | Germany | 242/118.11 |
| 2747423 | 4/1978 | Germany . | |
| 490261 | 6/1970 | Switzerland . | |
| WO80/00147 | 2/1980 | WIPO . | |

*Primary Examiner*—Michael R. Mansen
*Attorney, Agent, or Firm*—Young & Thompson

[57] ABSTRACT

A radially compressible cylindrical cop for supporting yarn in the form of a tubular body between two end annular elements and comprising a first set of longitudinal rigid rods arranged angularly equidistant one in respect of the other and a second set of longitudinal rods which can be deformed in their transverse direction and which are likewise angularly equidistant one in respect of the other and arranged in positions intermediate to the rigid rods of the first set. Each deformable rod is connected to the adjacent rigid rods by rigid transverse stiffening tacks arranged longitudinally equidistant one in respect of the other with the rigid tacks which originate from an adjacent rigid rod and which are arranged in a position intermediate to the rigid tacks originating from the opposite adjacent rigid rod.

9 Claims, 3 Drawing Sheets

RADIALLY COMPRESSIBLE COP FOR THE WINDING OF YARN

FIELD OF THE INVENTION

The present invention relates to a radially compressible cop for supporting a package of yarn. It relates more particularly to a cop suitable for supporting said yarn both during the steaming operation and during the subsequent dyeing operations.

BACKGROUND OF THE INVENTION

It is well known that the operation of steaming yarn consists essentially of heating said yarns in a humid environment in order to fix the torsions whereto the filaments making up the yarn had previously been subjected. In general this operation of steaming also follows an operation of dyeing in order to confer the required colour to the yarns treated in this way.

Traditionally, in order to subject the yarn to these two operations, the yarn was first of all wound on a first cop for steaming, consisting of a cylindrical element having a lateral yarn winding wall which is solid and radially contractible when hot in order to adapt to the contraction which the yarn wound thereon undergoes during this operation, while for the subsequent dyeing operation it was necessary to use a different cop having a perforated lateral surface, suitable for the dye to pass through, in order to obtain uniform colouring of the yarn wound thereon. To avoid this need to unwind the yarn from cops intended for steaming in order to wind them on those intended for dyeing, cops have been provided which are suitable for both operations. These cops comprise essentially a perforated lateral wall capable of contracting radially.

Said cops are also housed for performing the abovementioned operations in autoclaves and stacked one on top of the other. They must therefore have a structure which, in addition to being radially contractable, is also sufficiently rigid and stable in order to withstand the considerable axial loads whereto it is subjected.

Known radially collapsible perforated cops consist essentially of a cylindrical body for supporting yarn positioned between two end annular elements and which is defined by peripheral longitudinal rods which are all identical one to the other.

Said longitudinal rods are essentially of two types: either they are rods which can be deformed in a transverse direction and are connected one to the other by rigid spacers, wherein the transverse deformation of the rods is provided by portions thereof which deform on the thrust of said rigid spacers, or they consist of rigid elements connected via intermediate deformable elements which themselves provide the radial contraction of the cop. For example said longitudinal rods consist of elements with a "V" section which deform in order to generate said radial contraction of the cop by the plastic rotation of the branches of said "V", or in other cases are connected by intermediate elements formed by deformable "V"'s.

Whatever the manner of providing longitudinal rods defining the surface for winding the yarn and which are all identical one to the other, it is necessary, in order to confer sufficient rigidity and structural stability to the cop, to have longitudinal rods which are all of considerable size or which are arranged densely, too close one to the other and thus forming in both cases a considerable obstacle to the passage of the dye through the cop.

In order to overcome this disadvantage it was decided to perforate said longitudinal rods, although in this case too, in order not to weaken the cop excessively, use had to be made of cops with dimensions which are too small for solving the abovementioned problem satisfactorily.

Another disadvantage shown by some types of known cops consists of the fact that the radial contraction therein involves the risk of nipping of the wound yarn with the danger of breakage of the yarn itself.

In other types of known cops, during the phase of radial contraction, due to the excessive stiffening of the attachment between longitudinal rods and end flanges, said longitudinal rods break at the attachment to the end flanges of the cop.

A further problem presented by known radial contraction cops for dyeing consists of the fact that the surface of winding of the yarn has the same diameter as the end flanges of the cop. This entails the risk that in parts the yarn detaches from the cop on which said yarn is wound loosely, via which the dye leaks longitudinally and does not therefore pass through the lateral surface of the cop, that is to say through the yarn, involving a loss of liquid intended for dyeing with subsequent decrease in dyeing efficiency and the risk of uneven colouring of the yarn.

The object of the present invention is that of providing a cop for the winding of yarns which is radially compressible and has a structurally stable lateral surface with a sufficiently high percentage of holes to allow the passage of considerable quantities of the dyeing liquid.

Another object of the present invention is that of providing a radially collapsible cop which avoids the risks of nipping of the yarn and risks of breakage of elements of the cop during the phase of contraction of the same.

A further object of the present invention is that of providing a radially collapsible cop wherein the previous disadvantages of leakage or longitudinal percolation of the dyeing liquid have been eliminated.

SUMMARY OF THE INVENTION

The previous objects have been achieved mainly with a radially compressible cop for supporting yarn consisting of a tubular body having a longitudinal axis and a lateral cylindrical surface for yarn winding positioned between two end annular elements, said tubular body comprising longitudinal peripheral rods for connecting said end annular elements defining said yarn collection surface, characterised in that said longitudinal peripheral rods comprise a first set of rigid rods arranged angularly equidistant one from the other and a second set of rods which can be deformed in their transverse direction and which are also angularly equidistant one from the other and arranged in a position intermediate to said rigid rods of said first set, and in that each deformable rod is connected to the adjacent rigid rod by means of rigid and circumferential stiffening tacks arranged longitudinally equidistant one from the other, with the rigid tacks originating from an adjacent rigid rod and which are arranged in a position intermediate to the rigid tacks originating from the opposite adjacent rigid rod.

The fact that rigid rods capable of providing the required structural stability and deformable rods suitable for creating the required radial contraction are provided, allows said deformable rods to be shaped with an advantageously small thickness which allows considerable quantities of dye to pass through without the latter fact involving weakening of the structure of the cop.

Moreover, the fact of assigning the function of contraction only to a part of the elements forming the lateral winding surface allows, during the phase of radial contraction of said surface, stresses to be generated on the end flanges only in the areas of attachment of said deformable rods. The fact that said deformable rods are considerably distanced one from the other means that the stress which said deformable rods transmit due to the contraction at the end flanges can be distributed within said flanges without interfering with the stresses generated in the area of attachment by the other rods subjected to deformation, avoiding the risk of reaching maximum tensions which lead to the breakage of the attachment between said end annular elements and said longitudinal rods.

BRIEF DESCRIPTION OF DRAWINGS

Further features and advantages of the present invention will be made clearer on reading the following description relating to preferred embodiments and to be read with reference to the accompanying drawings, in which.

DISCLOSURE OF PREFERRED EMBODIMENTS OF THE INVENTION

Figure 1:
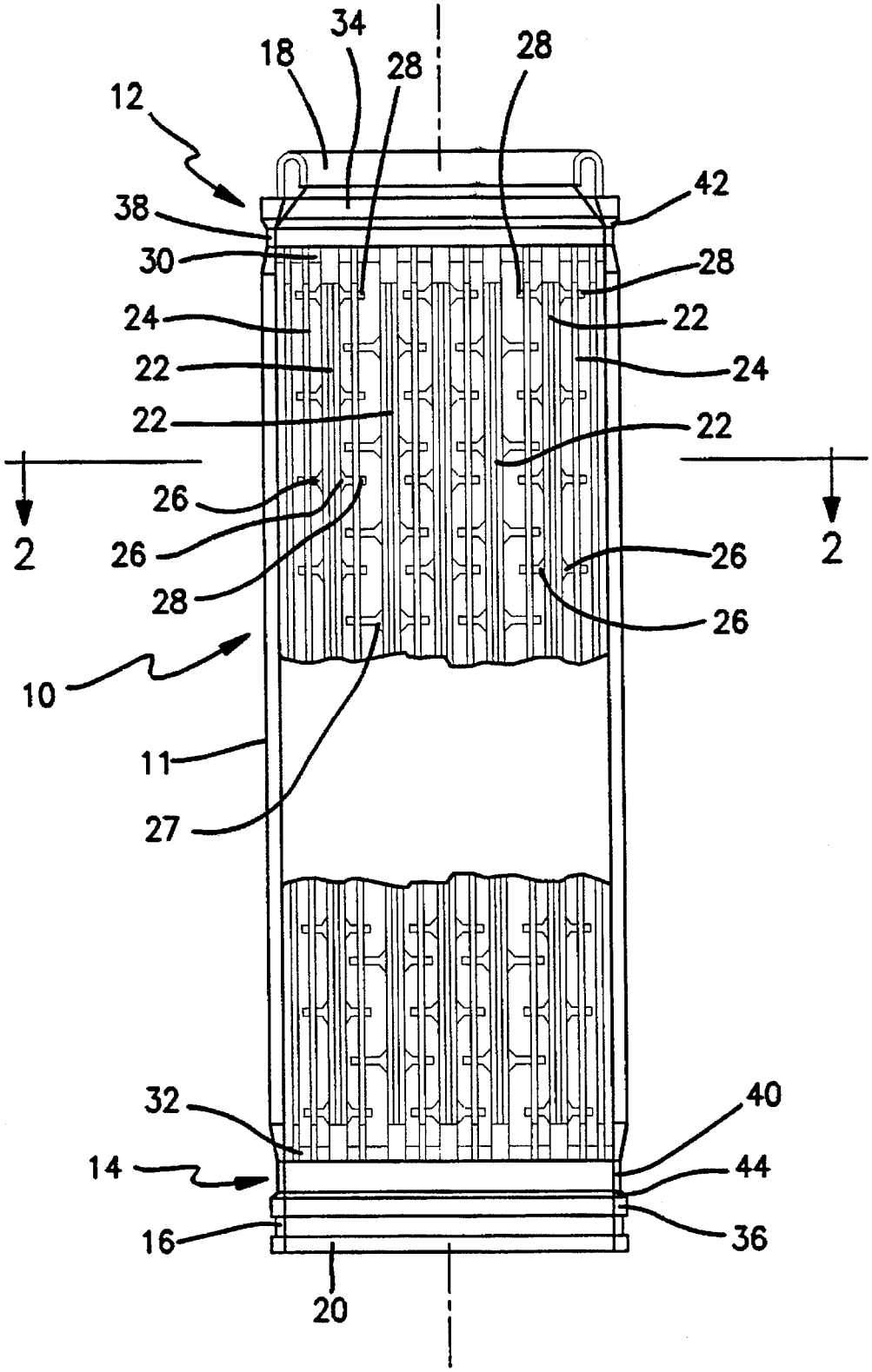
FIG. 1 represents a side view of the radially compressible cop of the present invention.

In the figures similar or equivalent elements are denoted by the same reference numerals.

Figure 2:
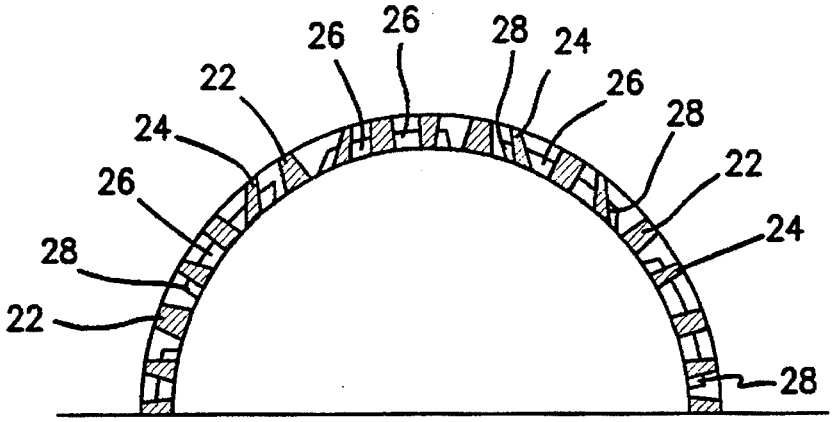
FIG. 2 is a section view along line 2—2 of half the tubular section of said cop.
Figure 3:
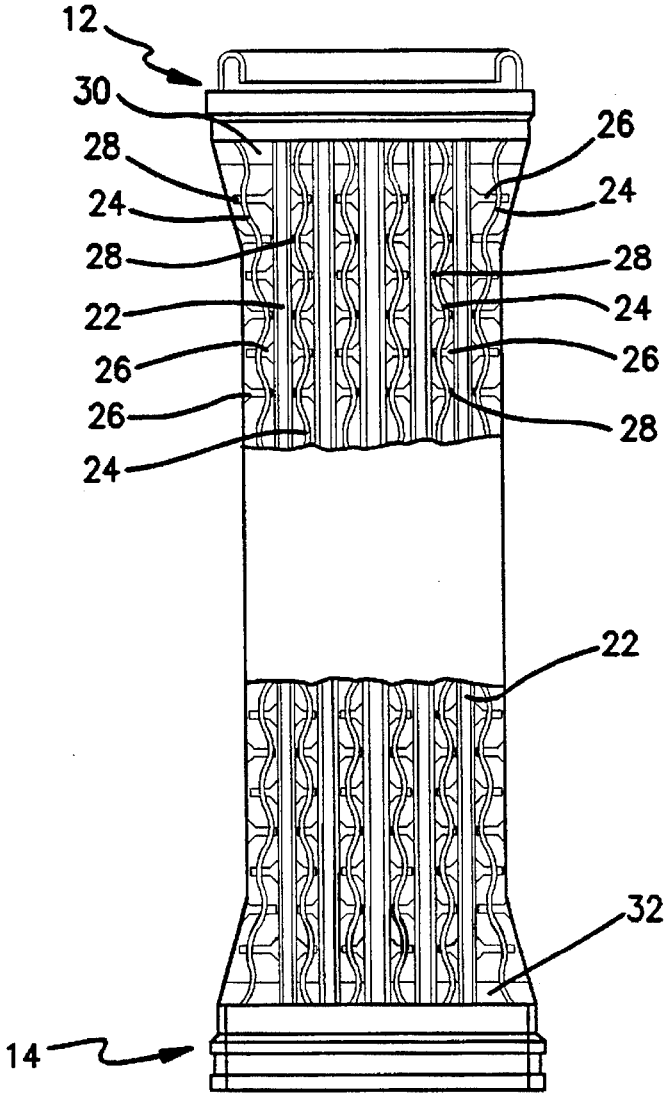
FIG. 3 is a side view of the cop of FIG. 1 in a radially collapsed condition.

FIGS. 1, 2 and 3 show a first preferred embodiment of the radially compressible cop according to the present invention. It comprises a tubular body 10 having a longitudinal axis and an external lateral cylindrical surface 11 for collecting the yarn and is held between two end annular elements 12, 14.

According to the invention the cop also comprises a lower annular zone 16 for forming a yarn reserve, in a manner in itself known, and an upper ring 18 having an external diameter which corresponds to the internal diameter of a lower element 20 to allow the cop to be stacked.

The tubular body 10 of the cop comprises, according to the invention, a double set of peripheral longitudinal rods which connect said annular elements 12, 14 and which define with their external face the surface 11 forwinding the yarn.

More specifically, the rods comprise a first set of rigid rods 22, which are arranged angularly equidistant one from the other, and a second set of deformable rods 24, which can be deformed in their transverse plane, also angularly equidistant one from the other and arranged in a position intermediate to the rigid rods 22 of the first set.

From the figures it can be seen that each deformable rod 24 is connected to the adjacent rigid rods 22 by means of stiffening parts or rigid tacks 26 arranged longitudinally equidistant one from the other in such a way that the rigid tacks 26 which originate from an adjacent rigid rod 22 are arranged in a position intermediate to the rigid tacks 26 which originate from the adjacent rigid rod 22.

As can be seen from FIG. 3, when the cop is compressed radially for contraction of the yarn wound thereon, the deformation of only the deformable rods 24 is caused, whereas the rigid rods 22 remain perfectly rectilinear. The deformable rods 24 bend plastically with opposite curves in the points of attachment of said rigid tacks 26 due to the transverse thrust exerted by the latter.

Advantageously according to this first embodiment, in order to confer greater rigidity and structural stability to the cop of the invention, the stiffening tacks 26 which connect a rigid rod 22 to an adjacent deformable rod 24 are on the extension of the tacks 26 which connect the same rigid rod 22 to the adjacent deformable rod 24 on the opposite side of the associated rigid rod from the previous deformable rod.

According to this first preferred embodiment, on the extension of the rigid tacks 26 a tooth or stopping part 28 is also provided which, as is clear from FIG. 3, forms an element for limiting radial contraction of said yarn collection surface. It allows the radial contraction of the winding surface of the cop to be controlled, allowing advantageously, in that it maintains said deformable rod 24, even after it has been deformed, detached from the adjacent rigid rod, a lateral winding surface to be obtained which has a considerable percentage of holes even in a collapsed condition.

As is fully clear from FIG. 2, said stiffening tacks 28 and said stopping teeth 28 have an arched profile and an external surface which is recessed in relation to the external surface of said rods 22, 24 defining the yarn winding surface, in this way the risk for the former of these drawing the yarn in the contraction movement of the cop, and for the latter the risks of nipping the yarn during radial contraction are avoided.

The cop is generally manufactured in a single moulded part of plastic material to form said rigid rods 22 and deformable rods 24, therefore it is sufficient to provide, as can be seen in FIG. 2, the rigid rods 22 with a resistant section sufficiently greater than that of the deformable rods 24, for example providing rigid rods 22 with a section equal to approximately double that of the deformable rods 24.

In order to avoid the risks of leakage or longitudinal percolation of the dyeing liquid, at said end annular elements 12, 14, in the area of attachment of said rods 22, 24 to said end annular elements 12, 14, thin and flexible rings 30, 32 have been provided, defining a sort of diaphragm which connects circumferentially said rigid rod to said deformable rods, so as to prevent the leakage of dyeing liquid towards said end annular elements 12 and 14.

In order to improve further this antipercolation effect, said end annular elements 12, 14 have been divided into a first end annular portion 34, 36 which has a specific external diameter, and into a second intermediate annular portion 38, 40 arranged between said first end annular portion and said cylindrical surface for collecting the yarn, which has a smaller external diameter than that of the first end annular portion, so that it is possible to deposit the yarn in contact with this second recessed annular portion and so that the annular step 42, 44 which separates said first annular portion from said second annular portion prevents further longitudinal percolation of the dyeing liquid.

Moreover, the fact that annular portions 38, 40 of the end annular elements 12, 14 intended for attachment of said longitudinal rods 22, 24 are provided with a smaller diameter or smaller thickness in order to be less rigid, means that these same portions 38, 40 can deform to follow the inflections of the deformable rods 24, so that for these too breakages of the attachment between rods 24 and end annular elements 12, 14 are avoided.

As is clear in the figures, said rigid tacks 26 are in the form of stems which have an enlarged reinforcement section 27 at the attachment of said tacks 26 with said rigid rods 22. This allows, in addition to conferring greater rigidity and stability during contraction to the cop structure as a whole in that whatsoever undesirable rotation or tilting of said tack 26 during contraction of the cop is avoided, the axial stresses of the tack 26 to be better distributed on said rigid rod 22 and the concentrated load effect which is caused on said deformable rod 24 to be avoided and which, together with the smaller sectional rigidity of the latter, is the cause of its plastic bending.

Figure 4:
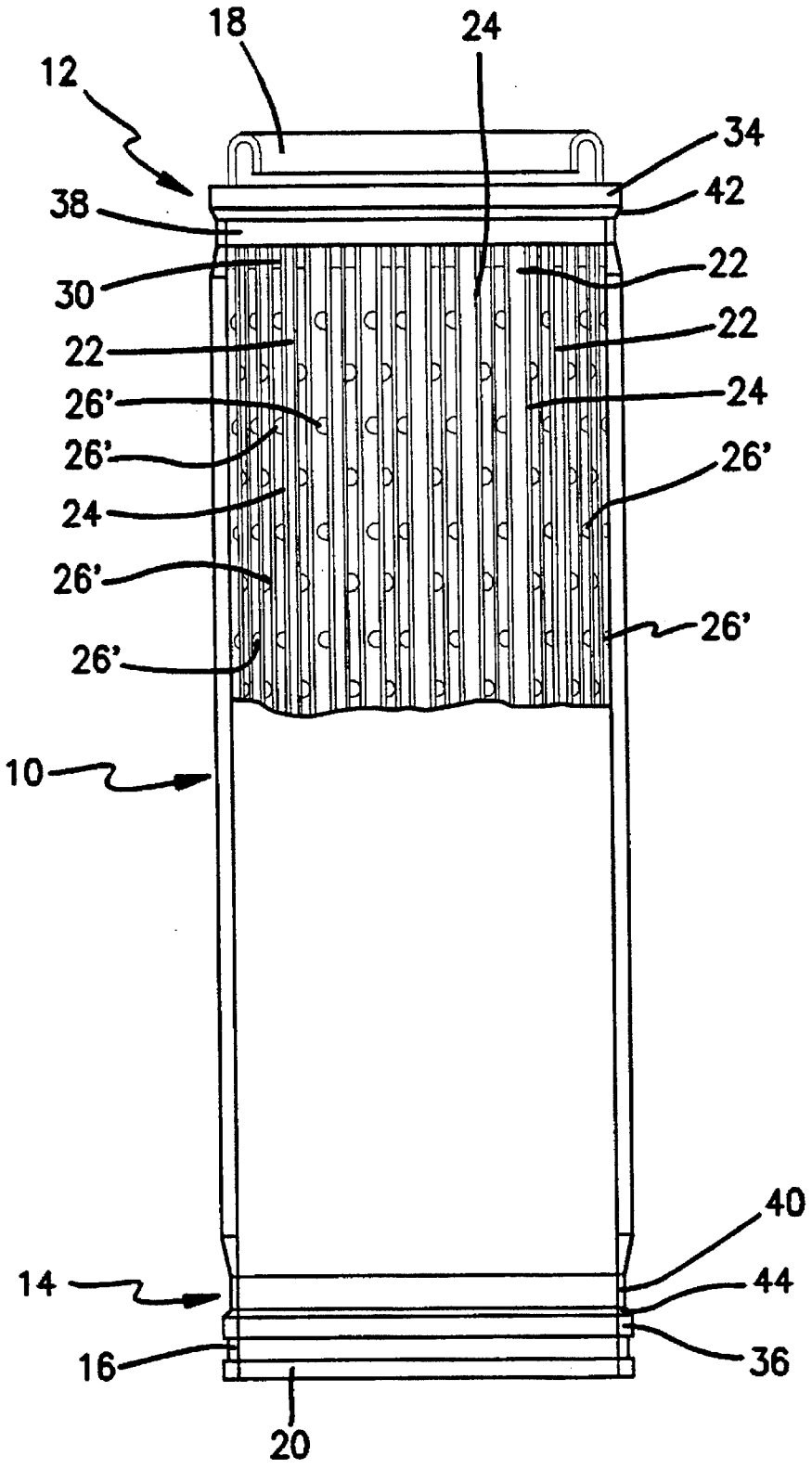
FIG. 4 is a side view of a second preferred embodiment of the cop forwinding yarns of the present invention.

A second preferred embodiment of the cop of the present invention is shown in FIG. 4. It also comprises a tubular body 10 having a longitudinal axis and a lateral cylindrical surface for collection of the yarn between two end annular elements 12, 14. The tubular body 10 comprises, here too, a first set of rigid rods 22 arranged angularly equidistant one from the other and a second set of rods which can be deformed in their transverse direction 24 and are also angularly equidistant one from the other and arranged in positions intermediate to said rigid rods of said first set. Each deformable rod 24 is then connected to the adjacent rigid rods 22 by means of rigid transverse stiffening tacks 26' arranged longitudinally equidistant one from the other, with the rigid tacks 26' which originate from an adjacent rigid rod 22 and which are arranged in a position intermediate to the rigid tacks 26' of the adjacent rigid rod 22.

This second embodiment is distinguished from the first embodiment by the fact that it does not have the tack elements 26' which extend from the same rigid rod 22 towards the two adjacent deformable rods 24 which are on the same circumferential line but which are instead arranged spaced one from the other, and also by the fact that it has said tack elements 26' with convex lateral faces.

It is to be understood that what has been written previously and shown with reference to the accompanying drawings has been given purely by way of nonlimiting examples of the inventive principle claimed.

What is claimed is:

1. A radially compressible cop for supporting yarns, comprising a tubular body having a longitudinal axis and a lateral cylindrical surface for collecting the yarn, two annular end elements at opposite ends of said tubular body, said tubular body comprising longitudinally extending parallel rods interconnecting said end annular elements, said rods comprising two sets of rods arranged angularly equidistant from each other, the rods of said first set being thicker in a direction peripherally of said tubular body than the rods of said second set, the rods of said first and second sets being disposed in alternate relation with each other, and transverse stiffening tacks interconnecting each rod of said first set with the rods of said second set that are disposed on opposite sides of each rod of the first set, said tacks being spaced apart longitudinally of each rod of said first set, each rod of said second set being connected to said tacks at longitudinally spaced points along each rod of said second set with said tacks disposed alternately on opposite sides of each rod of said second set, the rods of the second set being more deformable in a direction peripherally of said tubular body than the rods of the first set, whereby the rods of said second set can undergo deformation in alternately opposite peripheral directions lengthwise of the rods of the second set at the same time that the rods of the first set remain free from deformation in a direction peripherally of the tubular body.

2. A cop according to claim 1, wherein said tacks are arranged on said rods of said first set in pairs that extend from the rods of the first set in opposite peripheral directions.

3. A cop as claimed in claim 1, each tack extending from a rod of the first set to and beyond a rod of said second set thereby to limit radial contraction of said tubular body.

4. A cop according to claim 1, each said annular element having a portion of relatively large diameter spaced from said rods by a portion of relatively small diameter.

5. A cop according to claim 1, further comprising thin and flexible rings interconnecting said annular elements and said rods.

6. A cop according to claim 1, wherein said tacks have radially outer surfaces that are radially inwardly spaced from radially outer surfaces of said rods.

7. A cop according to claim 1, wherein said tacks are thicker where attached to said rods of said first set than where attached to said rods of said second set.

8. A cop according to claim 1, wherein said tacks are connected to said rods of said first set on alternately opposite sides of said rods of said first set in a direction lengthwise of the tubular body.

9. A cop as claimed in claim 1, wherein said tacks have radially outer surfaces that are convex.

* * * * *